US007281548B2

(12) United States Patent
Schmid et al.

(10) Patent No.: US 7,281,548 B2
(45) Date of Patent: Oct. 16, 2007

(54) WEAVING HEDDLE

(75) Inventors: Thomas Schmid, Balingen-Weilstetten (DE); Gerhard Pohl, Albstadt (DE); Johannes Bruske, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/539,292

(22) PCT Filed: Dec. 2, 2003

(86) PCT No.: PCT/EP03/13555

§ 371 (c)(1),
(2), (4) Date: Jun. 16, 2005

(87) PCT Pub. No.: WO2004/057076

PCT Pub. Date: Jul. 8, 2004

(65) Prior Publication Data

US 2006/0011252 A1 Jan. 19, 2006

(30) Foreign Application Priority Data

Dec. 19, 2002 (DE) ..... 102 60 024

(51) Int. Cl.
*D03C 9/00* (2006.01)

(52) U.S. Cl. ..... 139/93

(58) Field of Classification Search ..... 139/90–96
See application file for complete search history.

(56) References Cited

U.S. PATENT DOCUMENTS

| | | | | |
|---|---|---|---|---|
| 2,674,275 A * | 4/1954 | Blickenstorfer | ..... | 139/92 |
| 3,961,649 A * | 6/1976 | Palau | ..... | 139/82 |
| 4,342,339 A * | 8/1982 | Koch | ..... | 139/93 |
| 4,342,399 A * | 8/1982 | Stirling | ..... | 215/12.2 |
| 6,009,918 A * | 1/2000 | Beyaert | ..... | 139/92 |
| 6,883,554 B2 * | 4/2005 | Baumann et al. | ..... | 139/93 |

FOREIGN PATENT DOCUMENTS

| | | | |
|---|---|---|---|
| BE | 387926 | * | 4/1932 |
| DE | 29 35 504 B | | 9/1980 |
| DE | 195 48 176 C1 | | 8/1996 |
| DE | 100 35 886 A | | 2/2002 |
| DE | 10035886.1 | * | 2/2002 |
| NL | 8 200 107 A | | 8/1983 |
| NL | 8200107 | * | 8/1983 |

* cited by examiner

*Primary Examiner*—Gary L. Welch
*Assistant Examiner*—Andrew W Sutton
(74) *Attorney, Agent, or Firm*—Fitch, Even, Tabin & Flannery; Norman N. Kunitz

(57) ABSTRACT

An improved heddle (2), on its end eyelet (7), has a spring means (14) which braces the end eyelet (7) resiliently in at least one direction on a heddle support rail 3. The spring means (14) serves to avoid play between the heddle (2) and the heddle shaft (1). This provision makes it possible to increase the operating speed of power looms.

17 Claims, 7 Drawing Sheets

WEAVING HEDDLE

CROSS REFERENCE TO RELATED APPLICATION

This application is the National Stage filing under 35 U.S.C. 371 of International Application No. PCT/EP2003/013555, filed Dec. 2, 2003, and claims priority of German Patent Application No. 102 60 024.4, filed Dec. 19, 2002, which is incorporated herein, in its entirety, by reference.

BACKGROUND OF THE INVENTION

The invention relates to a heddle of the kind that can be used in particular as a weaving heddle in power looms.

From European Patent Disclosure EP 0874930 B1, a heddle shaft is known, between whose upper and lower crossbeams heddles are fastened. The heddles are kept stationary, spaced apart and parallel to one another. On both ends, they have one end eyelet each, which wraps around a heddle-holding profile section and is thus held by positive engagement. Moreover, each heddle has an eyelet, through which a yarn passes, such as a warp yarn of a power loom. In operation, the heddle shaft is moved back and forth with the heddles in the longitudinal direction of the heddles, and very high accelerations occur. Attempts have therefore been made to firmly clamp the heddles in such a way that the end eyelets have only little play, or none, at the associated profile section. To that end, it has been proposed that an expandable element be disposed on the heddle support profile section, in the form of a hose that can be subjected to fluid and penetrates the end eyelets parallel to the heddle support profile section and clamps firmly in the expanded state.

With this provision, the end eyelets can be fixed without play on the heddle shaft. However, this requires major effort and expense. In particular, the heddle shaft must be set up for this provision, and provisions must be made for securely and tightly enclosing the actuating fluid.

The play-free fixation of the heddles on the heddle shaft opens up the possibility, even at high operating speed and thus at major accelerations of the heddle shaft, of achieving a secure, controlled mode of operation. The effort and expense this involves, as in EP 0874930 B1, however, is relatively high.

From German Patent Disclosure DE 195 48 176, a heddle for a heddle shaft is known, the shape of whose end eyelets is adapted to the heddle support rail; one end eyelet surrounds the heddle support rail without play, and the opposite end eyelet of the heddle surrounds its associated heddle support rail with a play that is adapted to the maximum sagging of the heddle support rail.

Sagging of the heddle support rails is dependent primarily on the power levels of the power looms and increases if these power levels increase. It is thus extremely difficult for the sagging, which definitively determines the play of an end eyelet of the heddle of DE 195 48 176, in advance. Very often, this play can be ascertained, if at all, only in operation of the power loom.

From German Patent Disclosure DE 10035886 and British Patent 1959, a heddle for a heddle shaft is known that has an elastic connecting means between the heddle and its end eyelet. As a result, the heddle becomes more elastic, and subsequently suspending the heddle from the heddle support rail and replacing heddles in the heddle support rail are easier. However, forces of acceleration and braking must be transmitted from the end eyelet to the heddle via the elastic connecting means.

A heddle is also known from German Patent Disclosure DE 29 35 504, with a heddle shaft and with end eyelets that each fit on one end over a respective heddle support rail. The spacing of the inner bearing faces of the end eyelets from one another is greater than the spacing of the two outer edges of the two heddle support rails, so that the heddles are seated with play on the heddle support rails. To compensate for this play, a compression spring is disposed on one end eyelet; it is braced by one end on the end eyelet and by its other end on the heddle support rail. As a result, the compression spring tenses the opposite end eyelet against the heddle support rail.

The known heddles with separate spring elements require considerable production and manufacturing effort and expense. Moreover, their assembly requires not inconsiderable effort.

With this as the point of departure, it is the object of the invention to disclose a simple provision with which the upper limit for the operating speed of a power loom, which limit originates in the heddle shaft, can be increased still further.

SUMMARY OF THE INVENTION

This object is attained with a heddle ,particularly for power looms, having an elongated heddle body, which on one end has an end eyelet for securing the heddle to a heddle support rail, and having a spring means provided on the end eyelet. The particular advantage of attaining the object of the invention in this way is that it makes do without modification of the power loom, and in particular without modification of the heddle shaft. The spring means provided on the end eyelet or integrally connected to it enables the play-free supporting of the heddle with respect to the direction of motion of the heddle shaft, which matches the longitudinal direction of the heddle. Clattering, impacts and attendant digging in of the heddle head into the heddle support rail are reduced or suppressed as a result. Moreover, the spring means compensates for tolerances, so that the end eyelet can be kept tensed between two diametrically opposite faces, and lesser dimensional deviations of the heddle head or variations in spacing between the two pressure faces are compensated for by the spring means.

Moreover, the spring means provided on the end eyelet creates the precondition for being able to clamp the end eyelet and thus the heddle on the heddle support rail. For instance, a clamping means in the form of a movably supported pressure rail may be provided on the heddle support rail and firmly clamps the end eyelets in place. The spring means provided on the end eyelets make compensating for tolerances possible, so that all the end eyelets are relatively uniformly firmly tensed. This creates the prerequisites for a mechanical clamping device, in which a single clamping member or an individual clamping rail firmly clamps all the end eyelets.

The spring means furthermore provides a certain amount of buffering in the event of abrupt accelerations or braking events. It is embodied resiliently in the longitudinal direction of each heddle. Various embodiments are possible. In preferred embodiments, the spring means is embodied by a plane portion of the heddle head, and this portion is provided with one or more recesses to increase the axial resilience. The advantage of this embodiment is that the pitch of the heddles can be very close; that is, the spring means occupies no lateral installation space. Alternatively, however, it may be formed by a spring tongue, which is for instance laterally curved. The advantage of that embodiment may be increased resilience of the spring means.

The invention can be realized either in only one end eyelet of a heddle, or on both end eyelets provided on the ends of the heddle. In a version intended especially for high-speed looms, the heddle is provided on only one end with an end eyelet of the invention, while the other end is without an end eyelet. In that case, the free end of the heddle can be supported axially displaceably in a guide. In this way, relative motions between crossbeams of a heddle shaft that are located diametrically opposite one another cannot be transmitted to the heddle. Such relative motions can occur as a consequence of dynamic loads, when high accelerations are operative.

In a preferred version, the heddles are embodied as resistant to kinking. They can therefore transmit not only tensile forces but also compressive forces. Kink-resistance is attained for instance by means of a bending edge, or a bulge of the heddle, extending in the longitudinal direction of the heddle.

In a further preferred version, the heddles in the two portions that are each located between the end eyelet and the eyelet are embodied with different cross sections. Preferably, two different cross sections with different cross-sectional areas are employed; as a rule, a portion from the end eyelet to the eyelet has a constant cross section. The cross sections may differ in cross-sectional shape, for example. In addition or as an alternative, they may differ in terms of the area content of the cross-sectional area. For instance, the heddle may comprise a flat material of constant thickness, while the heddle portions have different widths, viewed from the flat side.

This offers the capability of providing the heddle with a thick cross section in the region where it is heavily stressed and with a thin cross section in the region of lesser stress. As a result, the weight of the heddle is reduced and hence the spring constant of the spring means of the end eyelet becomes less, which can mean a simpler shape of the spring means.

The end eyelets provided with the spring means permit firm clamping, as noted, by means of a clamping device provided on the heddle shaft. The clamping device preferably has a rigid clamping piece, which cooperates with the spring means, such as the end eyelets, and can be actuated mechanically, for instance via a wedge clamping device or via a means acted upon by fluid. The rigid embodiment of the clamping piece has the advantage that relatively strong forces at individual points can be withstood; that is, the end eyelets can be firmly clamped with strong forces.

BRIEF DESCRIPTION OF THE DRAWINGS

Further details of advantageous embodiments of the invention will become apparent from the drawings, the description, or the dependent claims.

Embodiments of the invention are illustrated in the drawings. Shown are.

DETAILED DESCRIPTION OF THE INVENTION

Figure 1:
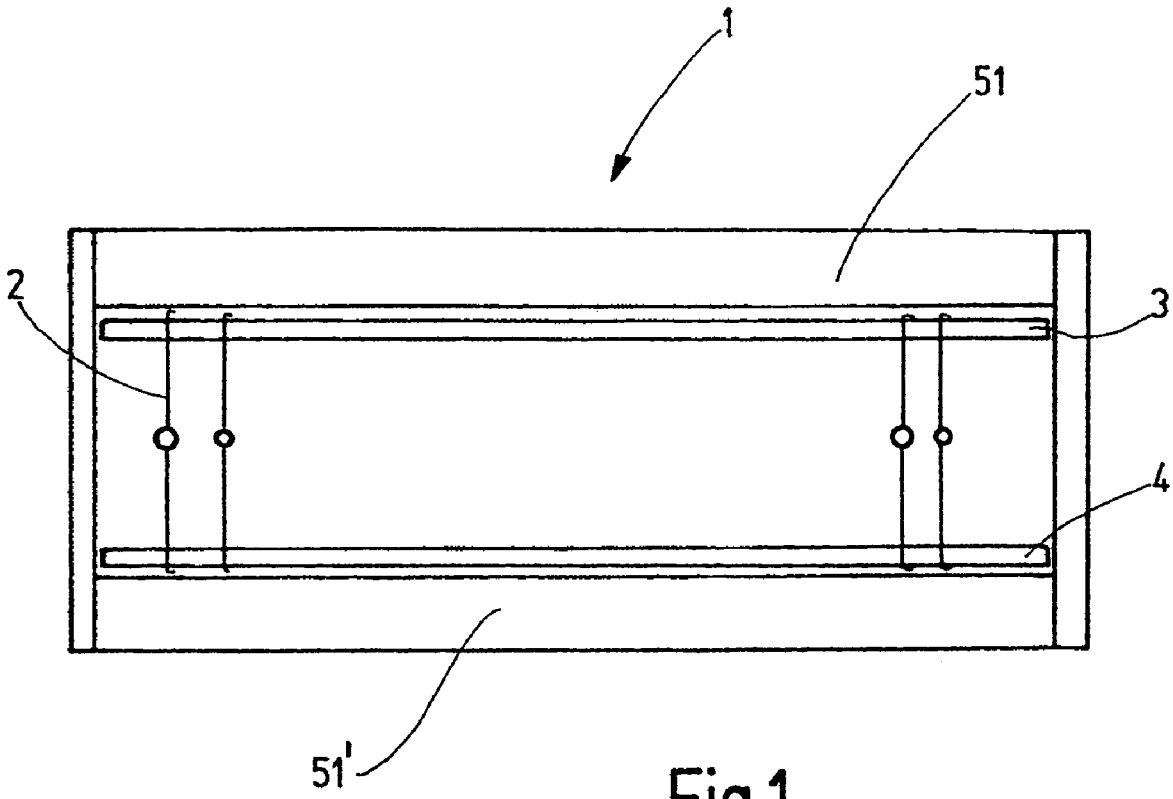
FIG. 1, a schematically illustrated heddle shaft, with support rods, associated heddle support rails, and heddles.

FIG. 1 schematically shows a heddle shaft 1 with two support or shaft rods 51 and 51', two associated heddle support rails 3 and 4, and heddles 2 according to the invention.

Figure 2:
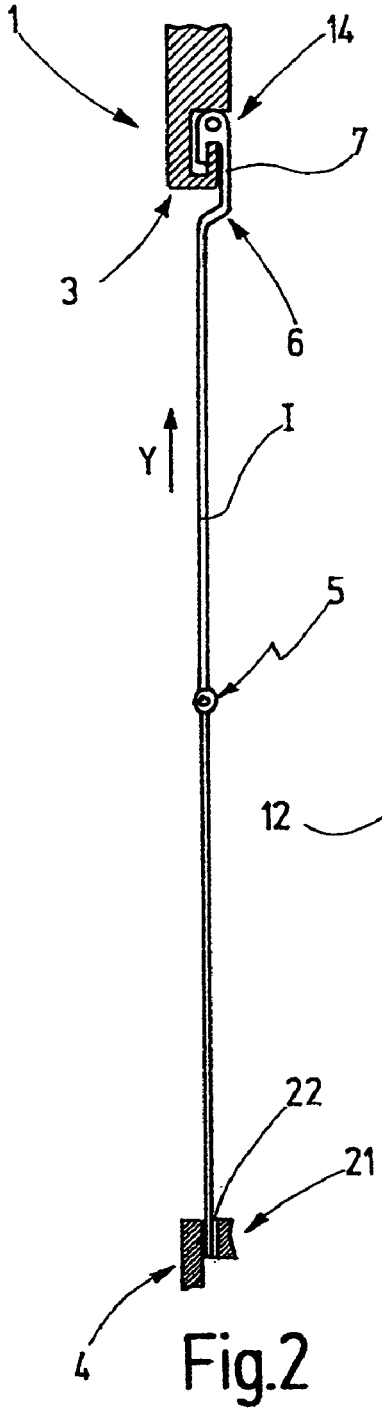
FIG. 2, a fragmentary cross-sectional view of heddle support rails with a heddle.

In FIG. 2, a detail is shown of the heddle shaft 1, which has a plurality of heddles 2 kept spaced apart and parallel to one another. The heddle shaft 1 has one upper heddle support rail 3 and one lower heddle support rail 4, which hold the upper and lower ends, respectively, of the heddle 2.

The heddle 2 comprises a flat material, which extends between the heddle support rails 3, 4 in the form of a flat strip (heddle body). An eyelet 5 is provided approximately in the middle. On at least one end, for instance the upper end 6, the heddle 2 has an end eyelet 7, which serves to secure the heddle 2 to the heddle support rail 3, and away from which the heddle body 10 extends. The end eyelet 7 is shown in greater detail in FIG. 3. It has a recess 8 which is open in the longitudinal direction Y of the heddle 2 and with which the heddle 2 is held on a jib 9 that is joined, preferably integrally, to the upper heddle support rail 3. The jib 9 has an upward-protruding rib in the longitudinal direction Y of the heddle 2; this rib is joined via a crosspiece 11 to an extension 12, oriented parallel to the jib 9, of the heddle support rail 3. The jib 9 is rounded off on its top. The jawlike recess 8 of the end eyelet 7 is also rounded off in that region.

A spring means 14 is embodied on the end eyelet 7, on the side facing away from the recess 8, and with this spring means the end eyelet 7 is braced on a pressure face 15 located opposite the jib 9. The pressure face 15 is embodied for instance on the heddle support rail 3.

The spring means 14 is formed for instance by a portion of the end eyelet 7, or of the heddle head, that is provided with an opening 16. Adjoining the recess 8, this portion extends away from the eyelet 5 and preferably comprises the same material as the rest of the end eyelet 7. The opening 16, which may for instance be embodied in the form of a round hole, is surrounded by a closed edge 17, which is curved in an arc on its outer side and at one point 18 touches the pressure face 15. The edge 17 has a certain resilience. If the spacing of the point 18 of the heddle 2 from the point 19 of the heddle 2, where the edge of the recess 8 touches the upper edge of the jib 9, is slightly greater than the spacing between the pressure face 15 and the point where the jib 9 and the heddle 2 touch, then the spring means 14, which is formed by the portion of the end eyelet 7 provided with the opening 16, can compensate for this oversize. The end eyelet 7 is then seated under tension on the jib 9 or on the heddle support rail 3. This precludes banging back and forth of the end eyelet 7 in the longitudinal direction Y. The end eyelet 7 is thus seated securely on the jib 9, specifically even if the recess 8, in the interstice defined between the jib 9 and the extension 12, is bounded by only a short leg 20. This in turn makes it possible to design very short, compact end eyelets 7 and correspondingly small heddle support rails 3, which can lead to a reduction in the moving masses.

The lower heddle support rail 4 (FIG. 2) may in principle be embodied like the upper heddle support rail 3. However, it is advantageous to guide the heddle 2, on its end diametrically opposite the end eyelet 7, not without play but rather with limited play, or as shown in FIG. 2, even with unlimited play. To that end, the lower heddle support rail 4 is provided with a receiving rail 21, which for each heddle 2 has a guide opening 22 extending in the longitudinal direction Y. In cross section, the guide opening approximately matches the cross section of the heddle 2, but has a certain oversize so that the heddle 2 is retained movably in the guide opening 22.

In operation, the heddle shaft 1 executes a reciprocating motion in the longitudinal direction Y of the heddle 2. Thus each yarn passing through the eyelet 5 is moved correspondingly upward or downward out of a warp yarn plane. The movement takes place virtually abruptly, with high forces of acceleration and braking. The requisite forces are introduced into the heddle 2 at the heddle support rail 3 on which the heddle 2 is held without play. In the upward motion, the end eyelet 7 is braced on the jib 9. Hardly any spring action can be found here. With respect to the downward motion, the end eyelet 7 is braced via the point 18 on the pressure face 15. The spring means 14 yields only insignificantly, if at all. It is designed as so stiff that it can transmit the required force of acceleration to the end eyelet 7, without the point 19 of the heddle lifting away from the jib 9. The stiffness of the spring means 14 may for instance be adjusted by means of the size of the opening 16. In that case, the width of the remaining edge 17 determines the resilience.

Figure 4:
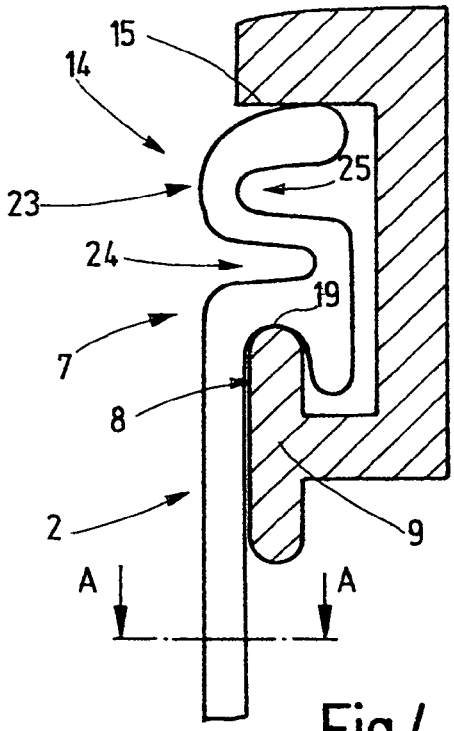
FIG. 4, a fragmentary cross-sectional view of a modified embodiment of a heddle support rail and a heddle.

In FIG. 4, a modified embodiment of a heddle 2 is shown. Its end eyelet 7 has a differently embodied spring means 14, but the heddle is otherwise embodied in agreement with the description above. The spring means 14 is again embodied as a compression spring 23, in that a portion of the end eyelet 7 extending away from the eyelet 5 and adjoining the recess is provided with lateral cutouts. The end eyelet 7, including the spring means 14 and the rest of the heddle 2, comprises a relatively thin metal sheet, from which it is cut out. The end eyelet 7 is completely plane; its two lateral, diametrically opposed cutouts 24, 25, offset from one another in the longitudinal direction Y, overlap one another. The remaining S-shaped portion is braced in turn with its upper end on the pressure face 15.

Figure 5:
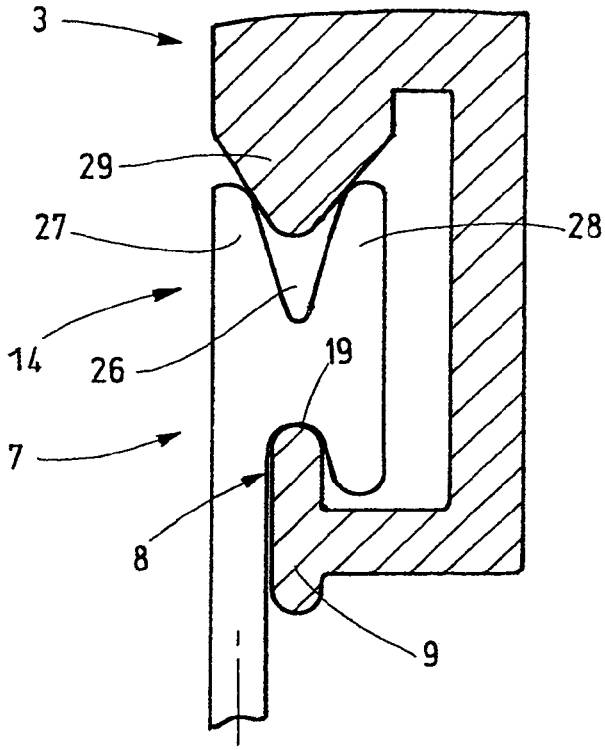
FIG. 5, a fragmentary cross-sectional view of a further embodiment of a heddle support rail and a heddle.

A further-modified embodiment of the heddle 2 and the heddle support rail is shown in FIG. 5. Once again, this involves an end eyelet 7 whose spring means 14 is located in the same plane as the end eyelet 7 itself. However, the spring means 14 is formed by a V-shaped notch 26, diametrically opposite the recess 8 in the direction away from the eyelet 5, which separates two legs 27, 28 from one another. The legs 27, 28 are braced on a pressure jib 29 of triangular cross section, which may be part of the jib 9 or of the heddle support rail 3. The dimensions are once again selected such that the pressure jib 29 reaches in prestressed fashion between the legs 27, 28, so that the end eyelet is held without play on the jib 9. The legs 27, 28 spread slightly apart and toward one another resiliently, and this resilience is converted, by the oblique faces of the pressure jib 29, into an axial compressive force with which the end eyelet 7 is pressed with its point 19 against the jib 9.

Figure 3:
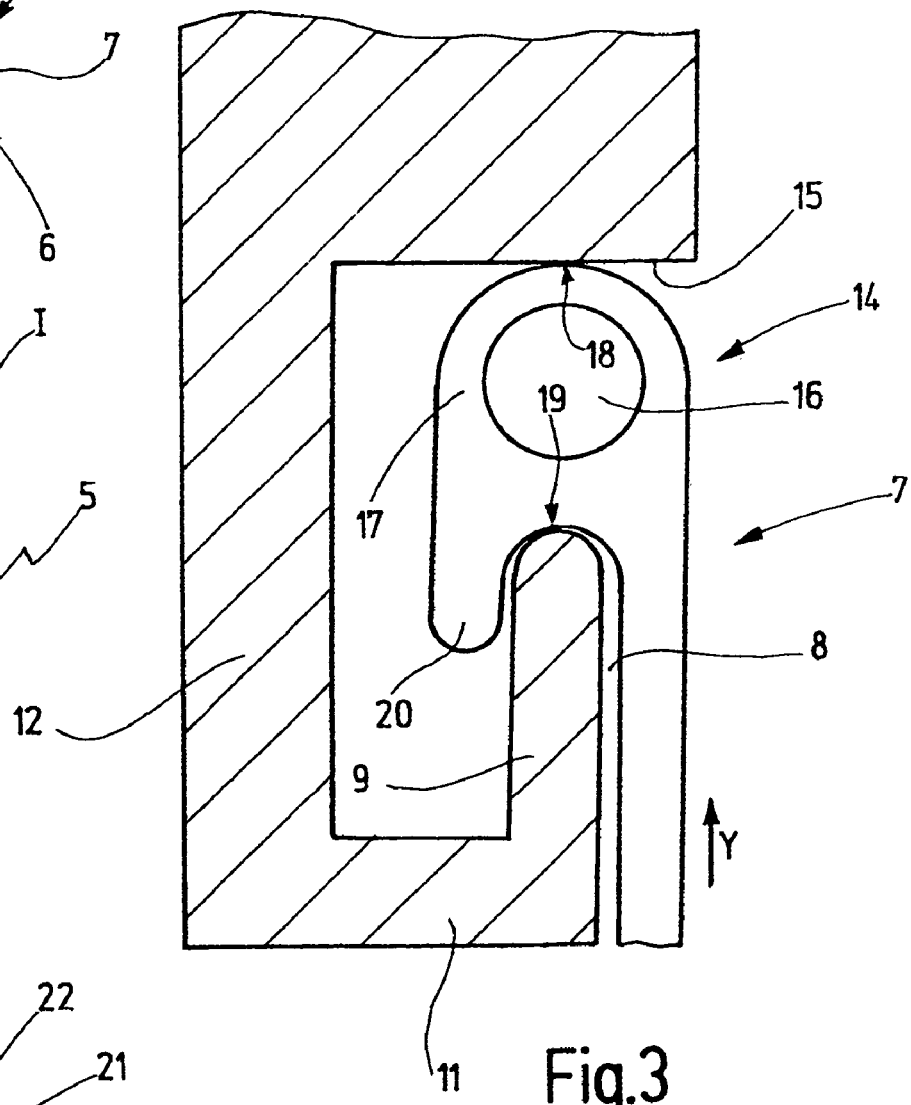
FIG. 3, a fragmentary cross-sectional view on a different scale of the heddle support rail and heddle of FIG. 1.
Figure 8:
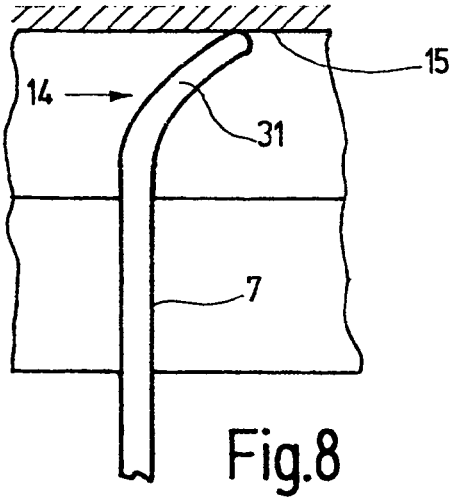
FIG. 8, a fragmentary front view of a further embodiment of a heddle support rail and a heddle.

A further-modified embodiment of the spring means 14 can be seen from FIG. 8. A portion 37 of the end eyelet 7 that has neither openings nor notches, or a portion embodied as in FIGS. 3 through 5, is bent laterally outward out of the plane of the rest of the end eyelet 7 and thus forms a curved spring tongue, with which the end eyelet 7 is braced on the pressure face 15.

Figure 7:
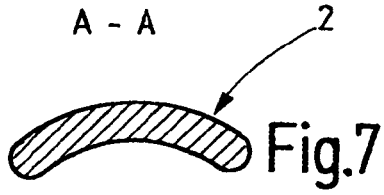
FIGS. 6 and 7, sections taken along a line A-A in FIG. 4 of heddles in various embodiments.
Figure 6:
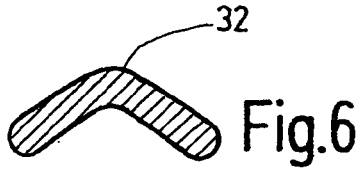

All the heddles 2 described above may, as needed and preferably, be reinforced with regard to their kink resistance upon pressure loading in the longitudinal direction Y. To that end, they may have a cross section as shown in FIG. 7. Adjoining its head, the heddle 2 is curved, as the section A-A in FIG. 5 shows. In other words, the heddle 2 is curved in channel-like fashion, thereby generating increased resistance to kinking. The bulge, optionally with the exception of the eyelet 5, preferably extends over the entire length of the heddle 2, up to the end eyelet 7 or into it. Alternatively, instead of the bulge of FIG. 7, a bending edge 32 as in FIG. 6 may be provided, which extends in the longitudinal direction Y. The bending edge 32 is preferably disposed approximately in the middle, so that it passes through the eyelet 5. In an alternative embodiment, it is also possible to provide two bending edges 32, making for an overall approximately Z-shaped cross section of the heddle 2. The advantage of that embodiment is that the bending edges 32 can extend on past the eyelet 5, which lends the heddle 2 particular rigidity, especially in the region of the eyelet 5.

Figure 12:
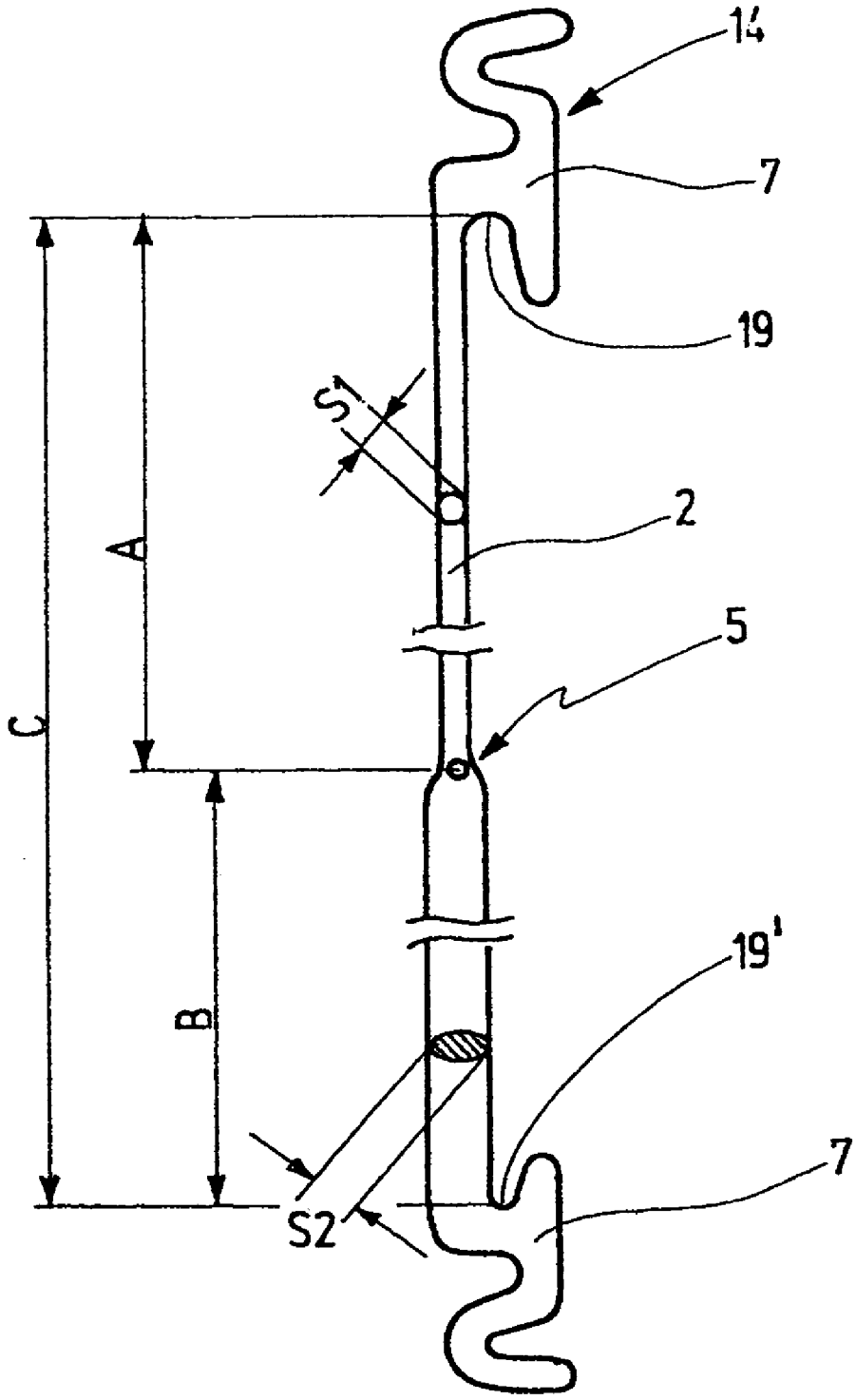
FIG. 12, a schematic view of a complete heddle of FIG. 4.

A further embodiment of a heddle 2 according to the invention is shown in FIG. 12. This heddle 2 is modified in terms of its weight, without modification of the end eyelets 7 or of the spring means 14. To that end, the distance C, from the point 19 where the heddle touches the heddle support rail in the upper region to the point 19' where the heddle 2 touches the heddle support rail in the lower region, is subdivided into two portions A and B. The first portion A, which extends from the region of the eyelet to the region of the beginning of the end eyelet, has a narrow cross section S1. In the portion B, which is located on the opposite side of the eyelet and also extends from the region of the eyelet to the region of the beginning of the end eyelet, the heddle 2 has a wider cross section S2. Preferably, the narrow portion with the cross section S1 is half as wide as the portion having the cross section S2. In addition or alternatively, the cross sections may have different shapes. In the exemplary embodiment of FIG. 12, the shape of the cross section changes in the vicinity of the eyelet 5 and in the transitional region between the end eyelet and the rest of the heddle 2. It is also possible for the cross sections located inside the portion C of the heddle 2 to be changed at other points. The different cross sections described above can be realized in heddles 2 with spring means of the most various shapes.

The cross sections of the individual portions A, B may be square, rectangular, oval, circular, elliptical, kidney-shaped, T-shaped, U-shaped, or the like.

Figure 9:
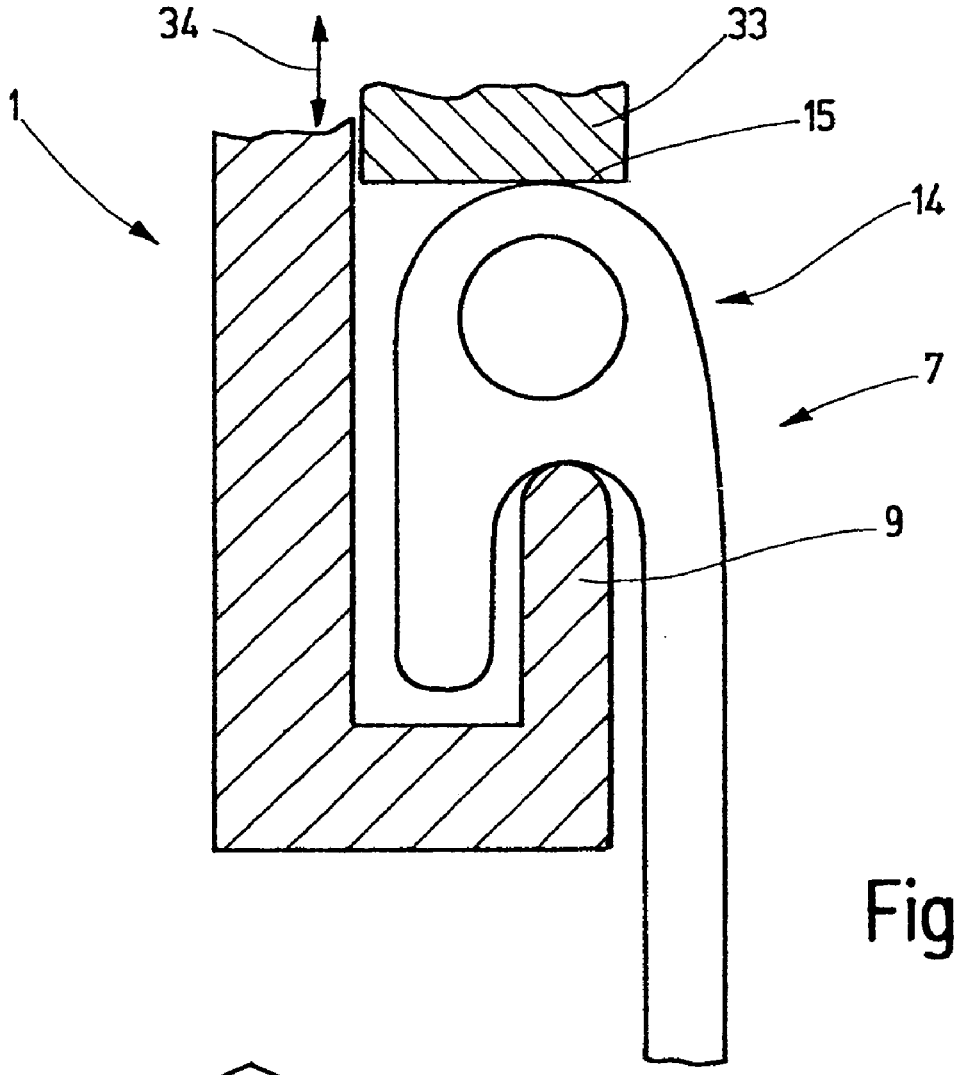
FIG. 9, a fragmentary cross-sectional view of a modified embodiment of a heddle support rail with a heddle.

In the above-described embodiments of the heddle shaft 1, it was initially assumed that the pressure face 15 has a fixed, unadjustable position relative to the jib 9 of the heddle support rail 3. However, the heddles 2 presented, provided with a spring means 14, are particularly suitable for a heddle support rail 3 of the kind seen in FIG. 9. In it, a rail 33, on which the pressure face 15 is embodied, and the jib 9 of the heddle support rail 3 are adjustable relative to one another in such a way that their spacing can be increased or decreased intentionally. This is represented in FIG. 9 by an arrow 34. The adjustability is advantageous particularly for the sake of equipping the heddle support rail 3 with heddles 2. In a first position, in which the rail 33 is removed from the jib 9, all the heddles 2 can be suspended from the heddle support rail 3 and also displaced along the heddle support rail 3. Once the heddles 2 have arrived at their respective desired position, they can be firmly clamped there, in that the rail 33 is moved in the direction of the jib 9 and in the process is clamped against the spring means 14 of the heddles 2. In the process, all the end eyelets 7 are firmly clamped on the jib 9. Any dimensional deviations between the heddle heads and end eyelets 7 are compensated for by the individual spring means 14 of the end eyelets 7.

Figure 10:
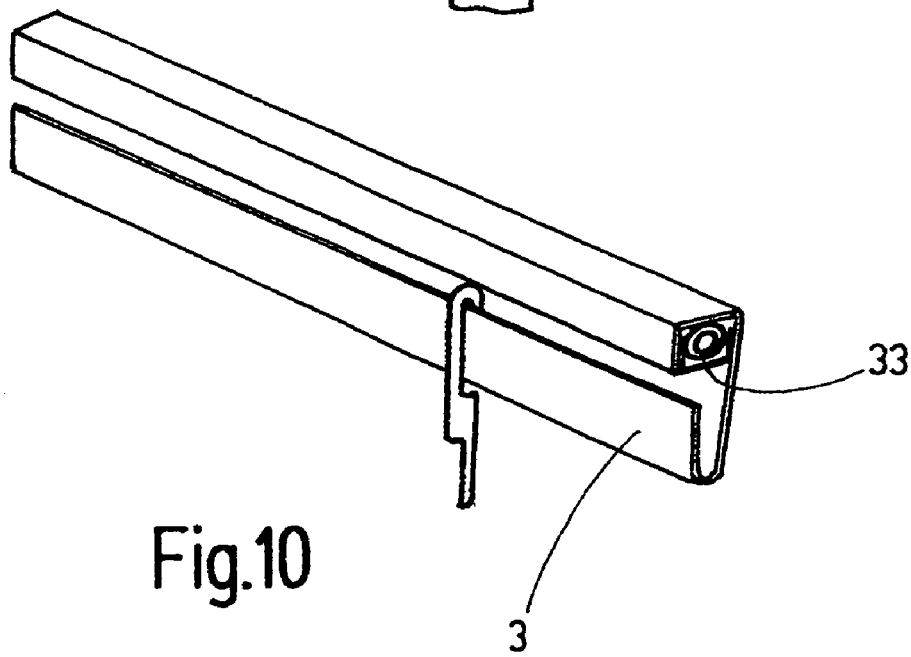
FIG. 10, a fragmentary perspective view of a heddle support rail with a mechanical adjusting device.
Figure 11:
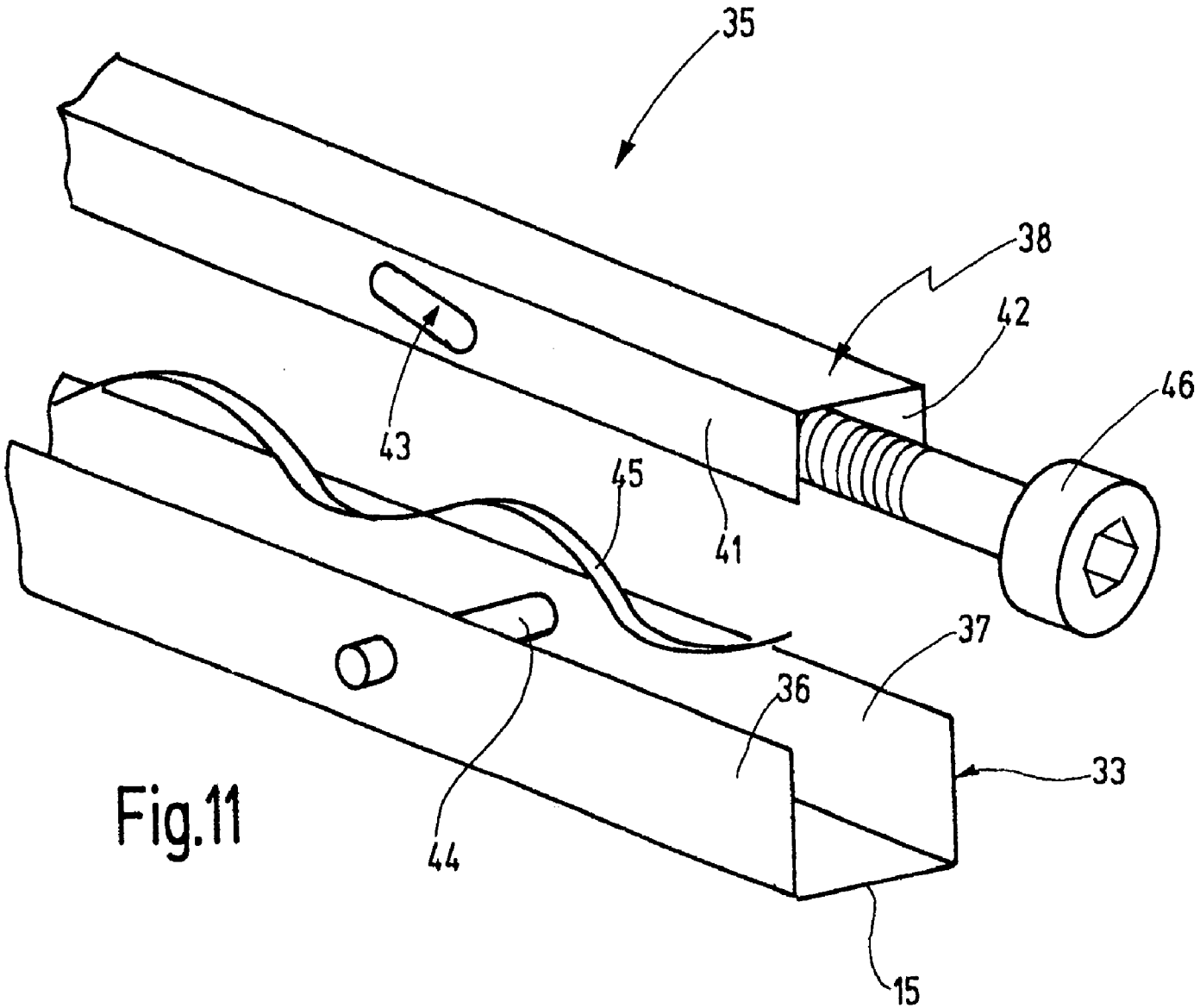
FIG. 11, a fragmentary exploded view of the heddle support rail of FIG. 10.

FIG. 10 shows one such heddle support rail 3 and the associated rail 33 in perspective. The rail 33 belongs to a clamping device 35 that can be seen from FIG. 11. The rail 33, for reinforcement, is formed for instance by a U-shaped profile section, whose legs 36, 37 protrude upward from the spine serving as a pressure face 15. Associated with the rail 33 is a conversely oriented, further rail 38 embodied as a U-shaped profile section, whose legs 41, 42 fit between the legs 36, 37. In the legs 41, 42, oblong slots 43 are embodied, which are inclined relative to the longitudinal direction of the rail 38. Associated with the oblong slots 43 are pins 44, which are retained in the legs 36, 37 and penetrate the oblong slots 43. The pins 44 together with the oblong slots 43 form a wedge device, which upon a longitudinal adjustment of the rails 33, 38 counter to one another causes the rails 33, 38 to move away from one another or toward one another.

An undulatingly curved leaf spring 45, disposed between the rails 33, 38, may be provided for tensing the rails 33, 38 away from one another. A threaded bolt 46 may furthermore serve to adjust the rails 33, 38 longitudinally counter to one another. Thus rotating the threaded bolt 46 causes an adjustment of the rail 33 and hence simultaneously a movement of the pressure face 15 away from or toward the jib 9 of the heddle support rail 3, 4.

Figure 13:
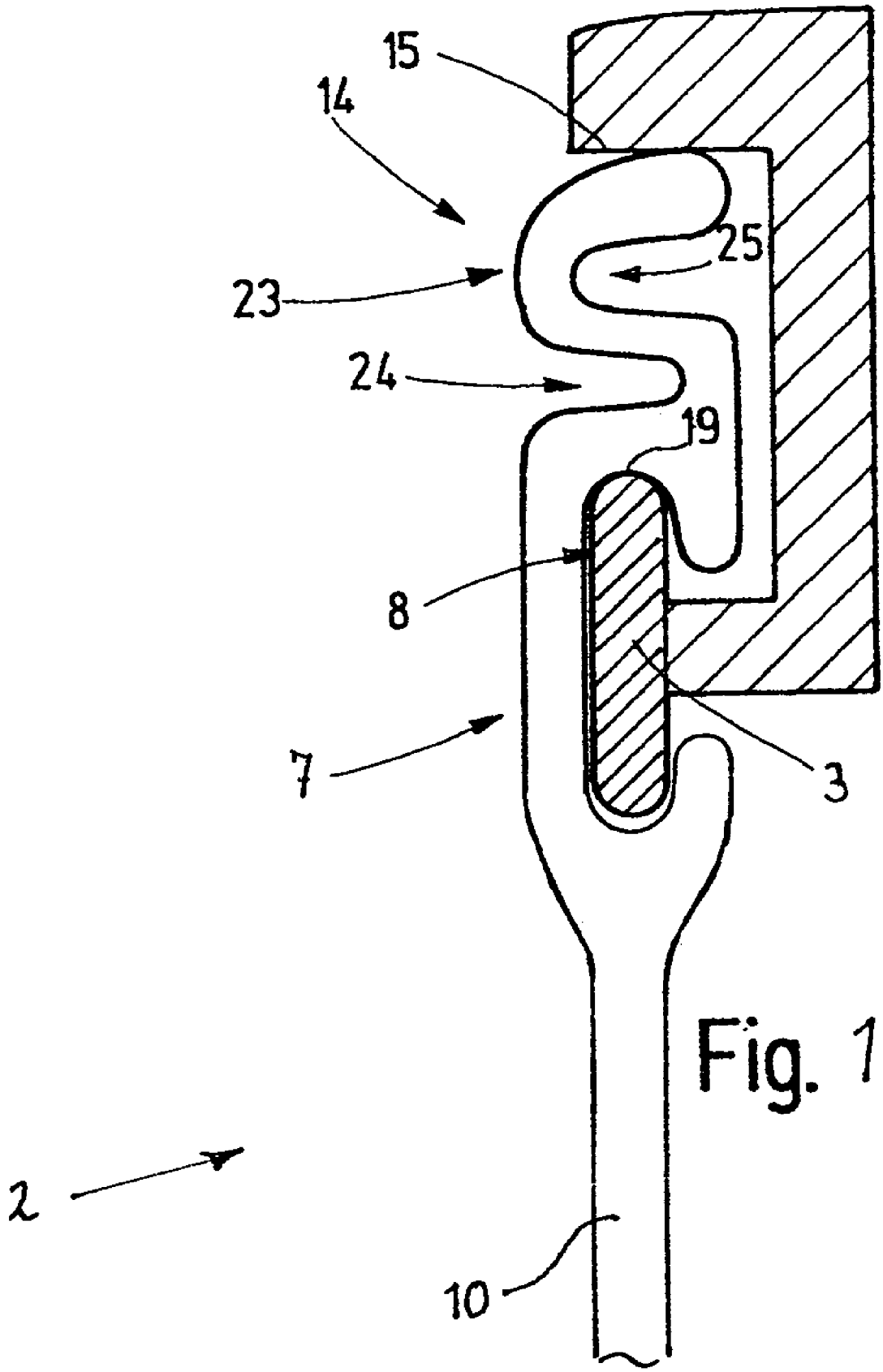
FIG. 13, a fragmentary cross-sectional view of a modified embodiment of a heddle and a heddle support rail.

In FIG. 13, still another embodiment of a heddle 2 is shown, with a C-shaped end eyelet 7. The elongated heddle body 10 extends in a first direction away from this end eyelet. The heddle body 10 may for instance be aligned with the heddle support rail 3, or offset from it. The spring means 14 formed by the compression spring 23 directly adjoins the end eyelet 7. The end eyelet 7 is preferably located on the side away from the heddle body. The spring means 14 shown is merely one exemplary embodiment. Instead of the compression spring 23, any other spring means 14 disposed in the above description may be employed, along with modifications thereof. The spring means 14 may serve to eliminate the play of the end eyelet 7 on the heddle support rail 3 and to damp the motion of the heddles. The spring means 14 in a first embodiment may be prestressed, so that the end eyelet 7 is pressed constantly against the heddle support rail 3, at least when the heddle shaft 1 is at rest. However, it is also possible to leave a certain play between the spring means 14 and the pressure face 15, which play is preferably less than the play, measured longitudinally of the heddle, of the end eyelet 7 on the heddle support rail 3.

Instead of the heddle support rail 3, which for instance is of steel, it is possible to provide a jib, for instance as in FIG. 4, which is embodied integrally with the shaft rod, and is for instance of aluminum or an aluminum alloy. The same is correspondingly true for all the exemplary embodiments above.

An improved heddle 2, on its end eyelet 7, has a spring means 14 which braces the end eyelet 7 resiliently in at least one direction on a heddle support rail 3. The spring means 14 serves to avoid play between the heddle 2 and the heddle shaft 1. This provision permits increasing the operating speed of power looms.

LIST OF REFERENCE NUMERALS

1 Heddle shaft
2 Heddle
3, 4 Heddle support rail
5 Eyelet
6 End
7 End eyelet
8 Recess
9 Jib
10 Heddle body
11 Crosspiece
12 Extension
14 Spring means
15 Pressure face
16 Opening
17 Edge
18, 19, 19' Point
20 Leg
21 Receiving rail
22 Guide opening
23 Compression spring
24, 25 Cutouts
26 Notch
27, 28 Legs
29 Pressure jib
31 Portion
32 Bending edge
33 Rail
34 Arrow
35 Clamping device
36, 37 Legs
38 Rail
41, 42 Legs
43 Oblong slots
44 Pin
45 Leaf spring
46 Threaded bolt
51, 51' Shaft rod
Y Longitudinal direction

The invention claimed is:

1. A heddle, in particular for power looms, comprising:

an elongated heddle body, which on one end has an end eyelet for securing the heddle to a heddle support rail, and a spring means provided on the end eyelet on a side thereof facing away from the heddle body for engaging a bearing surface spaced from and adjacent a heddle supporting rib of a heddle support rail; and wherein the spring means is integrally joined to the end eyelet on the side thereof facing away from the end eyelet.

2. The heddle according to claim 1, wherein the spring means is embodied as a tensioning means, for supporting the heddle in a prestressed fashion on a heddle support rail.

3. The heddle according to claim 1, wherein the spring means is formed by at least one resilient portion extending away from the end eyelet.

4. The heddle according to claim 1, wherein the spring means is embodied resiliently in the longitudinal direction (Y) of the heddle.

5. The heddle according to claim 1, wherein the spring means is embodied as a compression spring.

6. The heddle according to claim 1, wherein the spring means is embodied as a spiral spring.

7. The heddle according to claim 1, wherein the heddle is formed of a plane flat material, and the end eyelet is embodied as plane.

8. A heddle, in particular for power looms, comprising:

an elongated heddle body, which on one end has an end eyelet for securing the heddle to a heddle support rail, and a spring means provided on the end eyelet on a side thereof facing away from the heddle body for engaging a bearing surface spaced from and adjacent a heddle supporting rib of a heddle support rail, and wherein the heddle is formed of a plane flat material, and the spring means is embodied as plane.

9. A heddle, in particular for power looms, comprising:

an elongated heddle body, which on one end has an end eyelet for securing the heddle to a heddle support rail, and a spring means provided on the end eyelet on a side thereof facing away from the heddle body for engaging a bearing surface spaced from and adjacent a heddle supporting rib of a heddle support rail, and wherein the heddle is formed of a plane flat material, and the spring means is embodied by a curved spring tongue.

10. The heddle according to claim 1, wherein the heddle is embodied of a flat material and adjoining the end eyelet has an elongated portion, which is provided with a bending edge or a reinforcing bulge.

11. The heddle according to claim ,1 wherein the heddle, adjoining the end eyelet, has an elongated portion which has a center eyelet and which is divided into a plurality of portions extending from the center eyelet, and these portions have different cross-sectional areas.

12. The heddle according to claim 11, wherein the cross-sectional areas of the portions have a ratio in terms of the area they contain of 1 to 2.

13. The heddle according to claim 11, wherein the cross-sectional areas of the portions have profile sections that deviate from one another.

14. The A heddle support rail, supporting a heddle according to claim 1, wherein the heddle support rail has a rib for supporting the heddle at a face of the end eyelet opposite the spring means, and a bearing face that is spaced from the rib, extends transverse to the longitudinal direction of the heddle body, and is positioned to engage the spring means of the heddle supported on the rib, and wherein the bearing face is disposed in stationary fashion relative to the rib of the heddle support rail.

15. A heddle support rail, for receiving a heddle according to claim 1, wherein the heddle support rail has a rib for supporting a heddle at a face of the end eyelet opposite the spring means, and a bearing face that is spaced from the rib, extends transverse to the longitudinal direction of the heddle body, and is positioned to engage the spring means when a heddle is supported on the rib, and wherein the bearing face is supported adjustably relative to rib of the heddle support rail.

16. A heddle shaft with a heddle support rail having a heddle according to claim 1.

17. A heddle, in particular for power looms, comprising:

an elongated heddle body, which on one end has an end eyelet for securing the heddle to a heddle support rail; and, a spring that is provided on the end eyelet on a side thereof facing away from the heddle body, that extends away from the eyelet, and is an integral one-piece part of the heddle body.

* * * * *